United States Patent [19]

Willim

[11] Patent Number: 4,582,119

[45] Date of Patent: Apr. 15, 1986

[54] METHOD OF, AND APPARATUS FOR, CONTINUOUSLY CASTING METAL IN A MOLD CHAMBER HAVING COOLED ROTATING WALLS

[75] Inventor: Fritz Willim, Birmensdorf, Switzerland

[73] Assignee: Concast Service Union AG, Zürich, Switzerland

[21] Appl. No.: 715,987

[22] Filed: Mar. 25, 1985

[30] Foreign Application Priority Data

Apr. 6, 1984 [CH] Switzerland ..... 1738/84

[51] Int. Cl.[4] ..... B22D 11/06

[52] U.S. Cl. ..... 164/480; 164/428

[58] Field of Search ..... 164/480, 428, 429, 427, 164/431–434, 479, 481, 482, 488, 490, 437, 439, 440

[56] References Cited

U.S. PATENT DOCUMENTS 3,964,963 6/1976 Anderson ..... 164/428

*Primary Examiner*—Kuang Y. Lin

*Attorney, Agent, or Firm*—Werner W. Kleeman

[57] ABSTRACT

In a method for the continuous casting of metal, especially steel, in the form of strips or thin slabs, the molten metal is poured into a mold having cooled walls which move as the operation proceeds. To prevent defects in the strand and interference with the casting operation after the metal has flowed into the mold chamber, contact between the cooled narrow sides of the mold chamber and the liquid metal initially takes place at a contact face which represents only a fraction of the local separation distance between the two broad side cooling walls. Furthermore, before reaching the contact face, the metal is cooled in a gap between the feed inlet and the broad side wall extending between the narrow side walls. The cross-section of the gap opening corresponds substantially to the contact face.

6 Claims, 7 Drawing Figures

METHOD OF, AND APPARATUS FOR, CONTINUOUSLY CASTING METAL IN A MOLD CHAMBER HAVING COOLED ROTATING WALLS

CROSS REFERENCE TO A RELATED APPLICATION

This application is related to my co-pending, commonly assigned U.S. Pat. application Ser. No. 704,022, filed Feb. 21, 1985 and entitled Method And Apparatus For The Continuous Casting Of Metal Between Two Axially Parallel Cooled Cylinders. This application is also related to my commonly assigned, copending U.S. application Ser. No. 06/715,972, filed Mar. 25, 1985, and entitled "Apparatus For Closing The Sides of A Substantially Rectangular Mold Chamber In A Continuous Casting Installation"

BACKGROUND OF THE INVENTION

The present invention broadly relates to continuous casting and, more specifically, pertains to a new and improved method and apparatus for continuously casting metal in a mold chamber having cooled rotating walls.

Generally speaking, the present invention relates to a method of continuously casting metal, in particular steel, in the form of strips or thin slabs, wherein the molten metal is poured, with the aid of a feed means, between four cooled walls rotating in the direction of casting. The circumferential surface of a casting drum or roll cools a first broad side of the strip or slab forming in the mold chamber, a second cooled wall cools the other broad side of the strip or slab being formed, and two narrow side walls, which are moved with the first or second cooled wall, cool the narrow sides of the substantially rectangular strip or slab being formed. One of the two broad side walls extends between the narrow side walls. The invention also concerns an apparatus for performing the method. This apparatus comprises at least two cooled walls movable in a predetermined direction of casting, a feed means, a first cooled wall of said at least two cooled walls forming a first broad side cooling wall of a mold chamber, and a second cooled wall of said at least two cooled walls having a recess substantially complementary to a cross-section of the cast strand and forming a second broad side cooling wall and two narrow side cooling walls of said mold chamber.

In the continuous casting of metals, in particular steel, in the form of thin broad strips, high casting rates are necessary for the production capacities required in large scale industrial operations. In this connection, considerable difficulties arise in feeding the molten metal in a uniform manner into a broad shallow mold in which the metal solidifies at least at its surface. For solving these problems, continuous casting installations have been developed wherein the molten metal is passed between two rotating drums or between one rotating drum and a circulating belt and is allowed to solidify while in contact with the cooled walls defined by these elements. In such systems, the cooled walls move in synchronism with the strand so that it is prevented from translating in relation to the cooling walls.

The French Pat. No. 2,091,851, granted Jan. 21, 1972, discloses a method for the continuous casting of substantially rectangular steel strip. The molten metal is poured between two rotating casting drums, use being made of a ceramic feed means. A first casting drum has a depression in its circumferential surface and forms a broad or wide side and two narrow sides of a mold chamber. The second casting drum which, over the length of the mold chamber, extends or engages between the narrow sides of the first casting drum, forms the second broad or wide side of the mold chamber. These four cooled walls, which move in the direction of casting, form a mold which, because of its rotary movement, essentially travels with the strand.

Instead of two rotary drums, a single drum and a circulating belt may also be employed. To achieve a high casting capacity, a high speed movement of the drums is necessary on the one hand, and a relatively great length of mold chamber in the direction of casting is required on the other. With a long mold chamber, as required for reliably and safely achieving a high rate of casting, it is possible, by the appropriate choice of drum diameter in relation to the thickness of strip to be cast, to create a correspondingly large gap between the cooled broad sides at the ingate or pouring inlet side. This is advantageous as regards the feed of disadvantages arise as regards the narrow sides. Since the mold chamber, between the broad sides and beginning at the ingate or pouring inlet side, narrows continuously down to a gap corresponding to the thickness of the strand, solidification of the narrow sides of the strand must be initially inhibited if their deformation is to be avoided between the mutually approaching drum walls. Furthermore, the recess in one of the casting drums would have to be very deep. A gap of a certain width for preventing friction, wear et cetera or for accommodating thermal expansion is unavoidable between the mutually engaging roller and narrow side walls. In this known casting method it is therefore not possible to prevent molten steel from penetrating into this gap and it becomes solidified in the form of adhering burrs, sometimes called "feathers" or "brows", lying parallel to the narrow sides. These burrs or "feathers" are joined to the simultaneously forming skin on the broad side of the strip. They prevent shrinkage or detachment from the drum which normally occurs upon cooling of the broad side. This leads to defects in the strand and in particular to cracks or even metal breakouts which require immediate interruption of the casting operation.

SUMMARY OF THE INVENTION

Therefore, with the foregoing in mind, it is a primary object of the present invention to provide a new and improved method and apparatus for the continuous casting of metals which does not exhibit the aforementioned drawbacks and shortcomings of the prior art constructions.

Another and more specific object of the present invention aims at providing a new and improved method and apparatus of the previously mentioned type for the continuous casting of metals which prevents the above-mentioned defects in strip-casting installations having a high production capacity.

It is a particular object of the invention to prevent the formation of burrs or "brows" and "feathers" which lie parallel to the narrow sides of the cast strand and project beyond a broad or wide side thereof, so that cracks in the material of the strand as well as breakouts and other casting defects are avoided.

Yet a further significant object of the present invention aims at providing a new and improved apparatus of the character described for the continuous casting of metals which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the method of the present invention is manifested by the features that after the metal has flowed into the mold chamber, contact between the cooled narrow sides of the mold chamber and the liquid metal is initially maintained only at a contact face which corresponds to only a fraction of the distance separating the two broad or wide side cooling walls and, before reaching the contact face, the metal is cooled in a gap between the feed means and the broad or wide side wall extending between the narrow side walls, the cross-section of this gap opening corresponding substantially to the contact face.

The apparatus of the present invention is manifested by the features that the feed means is provided with extensions within the mold chamber and extending in the direction of casting which are arranged along the two cooled narrow side walls, while the guide means form a gap opening conjointly with the cooling wall engaging or extending into the recess which ensures inflow of liquid metal.

The solution proposed by the present invention enables the poured metal, prior to reaching the contact face at the narrow side, to be greatly cooled in the gap between the drum, engaging at the broad side, and the extension of the feed means, as a thin layer of metal undergoing continuous solidification. The further feed of metal for filling the gap, gradually expanding towards the narrow side, along the uncooled extension of the ceramic or refractory metal-feed means is maintained. As this happens, the flowing metal yields part of its heat to the drum through the already solidified layer, so that on the one hand, the already solidified layer builds up further and, on the other hand, the viscosity of the metal moving along it increases. Penetration of molten metal into the interface gap or interstice between the engaging circumferential surface of the drum and the narrow sides is thus prevented. As soon as the crust or shell of the broad side has solidified as far as the narrow side wall, it increases in thickness and initiation of solidification of the crust or shell also takes place at the narrow side wall, which is already cooled at this point. The danger of the formation of a burr or "feather" therefore no longer exists.

According to a further feature of the invention and for the purpose of preventing friction in the gap opening, friction between the solidifying metal and the refractory feed means, the contact face and the corresponding gap opening increase in size in the casting direction.

According to yet another feature of the invention, control of solidification of the narrow sides of the strip or of a thin slab is achieved in the mold chamber if, after the metal has flowed into the mold chamber, contact between the cooled narrow sides of the mold chamber and the poured metal is initially prevented over the first portion or region of the length of the mold chamber and is ensured over a second portion or region of its length on a contact face which corresponds to only a fraction of the local separation distance between the broad or wide side cooling walls. Contact is also ensured along a third portion or region of the length of the mold chamber at a contact face which corresponds to the complete or final separation distance between the broad side cooling walls in the mold chamber.

The use of the method and the apparatus of the present invention enables the quality of the strand to be improved at the narrow sides and the wear on the drums to be reduced.

The size of the gap opening as well as of the length of flow of the metal in the gap itself has to be adapted to the casting rate, the shape of the cast product, the casting metal and the cooling capacity of the cooling wall. In accordance with a further feature of the invention, the recommended average size of a gap opening is 1/12 to ½ of the local cooling wall separation distance of the broad or wide sides.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
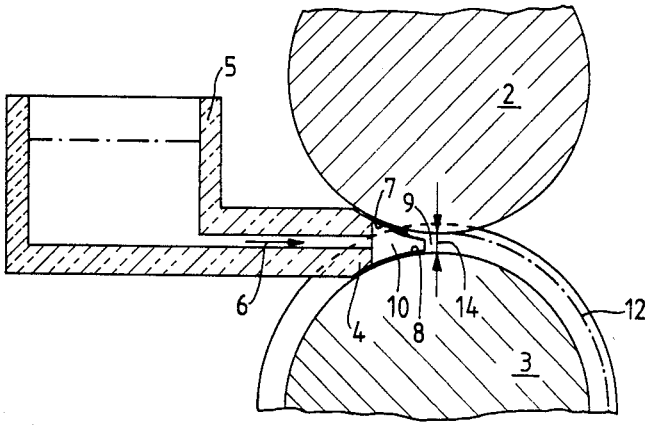
FIG. 1 shows a vertical section through part of a diagrammatically illustrated strip-casting installation.
Figure 2:
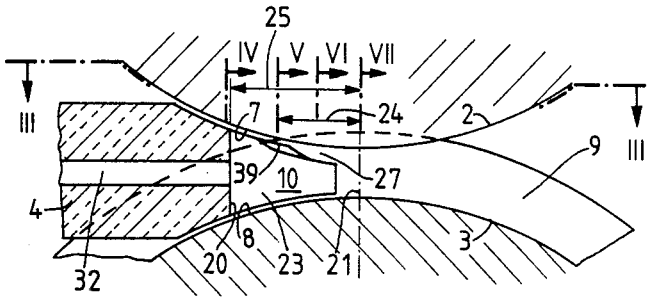
FIG. 2 is a vertical section through a mold chamber.
Figure 3:
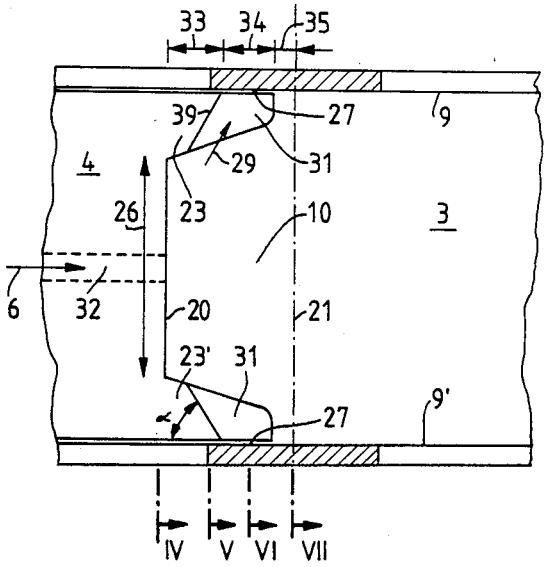
FIG. 3 shows a section taken along line III—III of FIG. 2.
Figure 4:
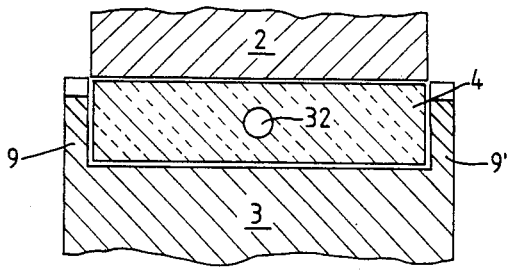
FIGS. 4–7 are sections taken along the lines IV—IV, V—V, VI—VI and VII—VII, respectively, of FIG. 2.
Figure 5:
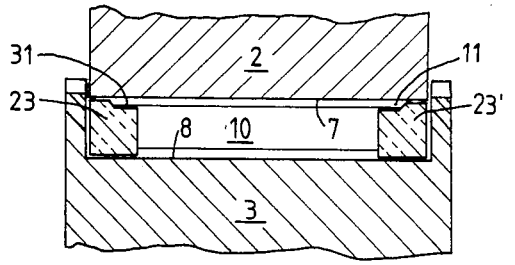
Figure 6:
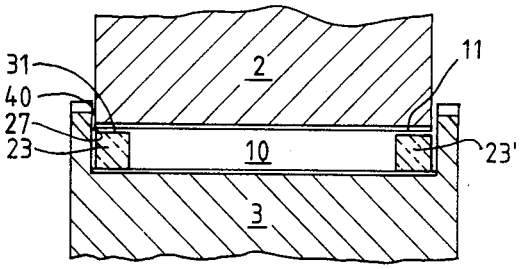
Figure 7:
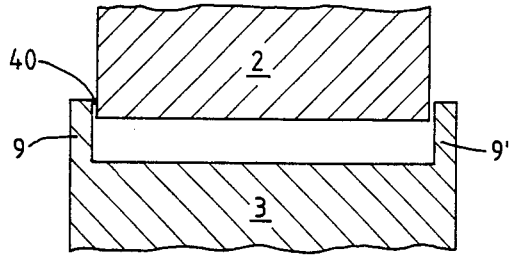

Describing now the drawings, it is to be understood that to simplify the showing thereof only enough of the structure of the apparatus for continuously casting metals has been illustrated therein as is needed to enable one skilled in the art to readily understand the underlying principles and concepts of this invention. Turning now specifically to FIG. 1 of the drawings, the apparatus illustrated therein by way of example and not limitation and employed to realize the method as hereinbefore described will be seen to comprise a continuous-casting installation for strips and thin slabs in which mold walls move as the casting or pouring operation proceeds. The installation comprises two substantially cylindrical casting drums or rolls 2 and 3 and a feed means 4. One of the two casting drums could be replaced by a moving cooling wall in the form of a belt or belt-like structure.

Molten metal is fed from a container or tundish 5 in a pouring direction 6 and is passed between the two casting drums 2 and 3. These two casting drums 2 and 3 comprise cooled walls 7, 8 and 9 which conjointly form a mold chamber or shaping cavity 10. After emerging from a narrowest gap or gap opening 14, which also constitutes the end of the mold chamber 10, a cast strand 12, indicated by a dash-dot line in FIG. 1, is advanced along a straight or curved path, as illustrated in FIG. 1, and is cooled and, if necessary, supported or restrained.

In FIGS. 2–7, the two casting drums 2 and 3 and the feed means 4 are illustrated only in part. The casting drum 2 forms, for example, a first cooled broad or wide side wall 7 and the casting drum 3 forms both a second cooled broad or wide side wall 8 and two narrow side walls 9 and 9'. The mold chamber 10 begins at a face 20 of the feed means 4 and terminates at the dash-dot line 21, which coincides with the narrowest gap 14 between the two casting drums 2 and 3. The mold chamber 10 is initially delimited at the sides or laterally by extensions 23 and 23' of the feed means 4 disposed one at each side, and then by the cooled narrow side walls 9 and 9'. Over a portion 24 of the length 25 of the mold chamber 10, the casting drum 2 engages or extends between the narrow side walls 9 and 9'.

After the metal has flowed into the mold chamber 10, the broad or wide side walls 7 and 8 first cool the two broad or wide sides of the strand 12 being formed over a portion 26 of the width of the strand 12. At the narrow sides of the strand 12 being formed, contact of the molten metal with the cooled narrow side faces or walls 9 and 9' of the casting drum 3 initially occurs only along a contact face 27 which corresponds to only a fraction of the local separation distance between the two broad side walls 7 and 8. As indicated by the arrow 29, the metal, before reaching the contact face 27, is intentionally cooled in a gap 11 between the extensions 23 and 23' of the feed means 4 and the broad side wall 7 of the casting drum 2. The cross-section of the gap or gap opening 11 (FIGS. 5 and 6), which is determined by stepped protrusions 31 of the extensions 23 and 23', corresponds substantially to the contact face 27.

The contact face 27 and the corresponding gap opening 11 increase in size in the direction 6 of casting. Depending upon the thickness of strip and the casting rate, the gap or gap opening 11 usually amounts to from 1/12 to $\frac{1}{2}$ of the local cooling wall separation distance between the broad sides. In the illustrated example, the mold chamber 10 is divided into three portions or zones 33, 34 and 35 along its length. After the metal has flowed from a feed duct or conduit 32 into the mold chamber 10, contact between the narrow side wall 9 and the metal being cast is inhibited along the first partial length or zone 33.

Over the second partial length or zone 34, the metal flows through the gap or gap opening 11 towards the contact face 27. The gap or gap opening 11 or the stepped protrusion 31 is advantageously of greater size towards the feed duct 32. A limiting edge 39 forms, in relation to the direction 6 of casting, an angle $\alpha$ of, for example 45°. Along the third partial length or zone 35, contact is established between the metal being cast and the cooled narrow sides 9 over a surface which corresponds to the full or final separation distance between the two broad side walls in the mold chamber 10. Early solidification of the cast metal in the gap or gap opening 11 along the broad side wall 7 prevents penetration of liquid metal into interface gaps or interstices 40 (FIGS. 6 and 7) parallel to the narrow side, in which gaps 40 there could otherwise be formed "feathers" or burrs which lead to the previously mentioned disadvantages.

The direction 6 of casting is shown as being horizontal in the examples; however, use can be made of any other casting direction, and it is particularly advantageous to cast the metal obliquely upwards.

While there are shown and described present preferred embodiments of the invention, it is to be distinctly understood that the invention is not limited thereto, but may be otherwise variously embodied and practiced within the scope of the following claims.

Accordingly, what I claim is:

1. A method of continuously casting metal, especially steel, in the form of strips or thin slabs, comprising the steps of:

pouring molten metal with the aid of a feed means between four cooled walls rotating in a predetermined direction of casting and at least partially defining a mold chamber;

the molten metal forming a substantially rectangular strip having a first broad side, a second broad side and two narrow sides;

cooling said first broad side of said substantially rectangular strip forming in said mold chamber by means of a circumferential surface of a casting drum defining a first broad side cooling wall of said four cooled walls;

cooling said second broad side of said substantially rectangular strip forming in said mold chamber by means of a second broad side cooling wall of said four cooled walls;

cooling said two narrow sides of said substantially rectangular strip being formed by means of two narrow side cooling walls of said four cooled walls, which are moved with one of said first and said second broad side cooling walls;

at least one broad side cooling wall of said first and said second broad side cooling walls engaging between said two narrow side cooling walls;

initially maintaining contact between said two narrow side cooling walls of said mold chamber and the molten metal after the metal has flowed into said mold chamber only at a contact face which corresponds to only a fraction of a local separation distance between said first and said second broad side cooling walls;

cooling the metal in a gap between said feed means and said at least one broad side cooling wall engaging between said two narrow side cooling walls before the metal reaches said contact face; and said gap defining a gap opening having a cross-section which substantially corresponds to said contact face.

2. The method as described in claim 1, wherein:

said contact face and said gap opening cross-section corresponding to said contact face increase in size in said predetermined direction of casting.

3. The method as described in claim 1, wherein:

said contact face and said gap opening cross-section corresponding to said contact face increase in size in said predetermined direction of casting;

contact between said narrow side cooling walls of said mold chamber and the metal being cast after the metal has flowed into said mold chamber being initially prevented over a first portion of the length of said mold chamber;

contact between said cooled narrow side walls of said mold chamber and the metal being cast being caused to take place along a second portion of the length of said mold chamber at a first partial contact face which corresponds to only a fraction of the local separation distance between said two broad side cooling walls; and contact between said cooled narrow side walls of said mold chamber and the metal being cast being caused to take place along a third portion of the length of said mold chamber at a second partial contact face corresponding to a final separation distance between said two broad side cooling walls in said mold chamber.

4. Apparatus for the continuous casting of metal, especially steel strands in the form of strips and thin slabs and the like, comprising:

at least two cooled walls movable in a predetermined direction of casting;

a feed means;

a first cooled wall of said at least two cooled walls forming a first broad side cooling wall of a mold chamber;

a second cooled wall of said at least two cooled walls having a recess substantially complementary to a cross-section of the cast strand and forming a second broad side cooling wall and two narrow side cooling walls of said mold chamber;

said feed means being provided, within said mold chamber and in said predetermined direction of casting, with extensions arranged along said two narrow side cooling walls;

said first broad side cooling wall engaging in said recess; and said feed means and said first broad side cooling wall conjointly forming a first gap opening and a second gap opening for ensuring inflow of molten metal, wherein the separation of the first gap opening is larger than that of second gap opening.

5. The apparatus as defined in claim 4, wherein:

said first gap opening is equal to at least 1/12 and at most ½ of the local separation distance between said first and second broad side cooling walls.

6. The apparatus as defined in claim 4 wherein:

said feed means in said mold chamber is provided with extensions extending in said predetermined direction of casting;

said extensions completely covering said two narrow side cooling walls along a first portion of the length of said mold chamber; and said extensions partially covering said two narrow side cooling walls along a second portion of the length of said mold chamber.

* * * * *